US008496106B1

(12) United States Patent
Bigg

(10) Patent No.: US 8,496,106 B1
(45) Date of Patent: Jul. 30, 2013

(54) KITS FOR USE BY AIRLINE TRAVELERS AND METHODS OF THEIR OPERATION

(76) Inventor: Joan Bigg, Croton On Hudson, NY (US)

( * ) Notice: Subject to any disclaimer, the term of this patent is extended or adjusted under 35 U.S.C. 154(b) by 0 days.

(21) Appl. No.: 13/606,114

(22) Filed: Sep. 7, 2012

Related U.S. Application Data

(60) Provisional application No. 61/533,951, filed on Sep. 13, 2011.

(51) Int. Cl.
*A45C 15/00* (2006.01)

(52) U.S. Cl.
USPC ..... 206/38

(58) Field of Classification Search
USPC ..... 206/232
See application file for complete search history.

(56) References Cited

U.S. PATENT DOCUMENTS

| | | | | |
|---|---|---|---|---|
| 3,368,655 | A * | 2/1968 | Purdy | 206/315.1 |
| 4,609,084 | A | 9/1986 | Thomas | |
| 6,164,442 | A * | 12/2000 | Stravitz | 206/233 |
| 6,183,133 | B1 * | 2/2001 | Roegner | 383/39 |
| 6,224,152 | B1 * | 5/2001 | Hughes et al. | 297/256.17 |
| D604,030 | S | 11/2009 | Wilson | |
| 7,900,757 | B2 * | 3/2011 | Sisitsky | 190/100 |
| 2003/0213826 | A1 | 11/2003 | Jacobs | |
| 2004/0045781 | A1 | 3/2004 | Scicluna et al. | |
| 2005/0232517 | A1 | 10/2005 | Reid | |
| 2006/0081487 | A1 * | 4/2006 | Hoelzle | 206/223 |
| 2007/0045138 | A1 * | 3/2007 | Schweitz | 206/315.1 |
| 2007/0122066 | A1 * | 5/2007 | Landay | 383/16 |
| 2007/0138222 | A1 | 6/2007 | Goldman | |
| 2009/0193685 | A1 | 8/2009 | Wilson | |
| 2010/0140310 | A1 * | 6/2010 | Goldberg et al. | 224/577 |

* cited by examiner

*Primary Examiner* — Jacob K Ackun
(74) *Attorney, Agent, or Firm* — Goldstein Law Offices, P.C.

(57) ABSTRACT

A kit for use by an airline traveler having an item of carry-on luggage in an airport having a security checkpoint where the traveler is required to remove the traveler's shoes for security inspection. The kit includes a pair of socks configured for wearing on the traveler's feet in order to keep unhygienic substances in proximity of the checkpoint away from the feet when the traveler walks through the checkpoint without the shoes. The kit includes a handheld travel pouch having an inner space and a pocket. The inner space is configured for storing the pair of socks. The pocket is configured for storing a card for providing proof of identity of the traveler. The pocket is configured for allowing of quick removal of the card for display at the checkpoint. The kit includes a means for securing the pouch to the item, the means coupled to the pouch.

20 Claims, 4 Drawing Sheets

KITS FOR USE BY AIRLINE TRAVELERS AND METHODS OF THEIR OPERATION

CROSS-REFERENCE TO RELATED APPLICATIONS

This application claims priority to U.S. Provisional Application Ser. No. 61/533,951, filed on Sep. 13, 2011, which is herein incorporated by reference in its entirety.

TECHNICAL FIELD

Generally, the present disclosure relates to kits for airline travel. More particularly, the present disclosure relates to kits for use by airline travelers and methods of their operation.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, this section should be understood that these statements are to be read in this light, and not as admissions of prior art. Likewise, in the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

Due to heightened security measures worldwide, air travel has become more complex in recent years. Airline travelers face an increased number of security checkpoints and require multiple types of documentation to pass each such checkpoint. The travelers often carry airline tickets, boarding passes, credit cards, airline club lounge membership cards, frequent flyer club membership cards, rental car club membership cards, a passport or other government issued identification document (ID), such as a driver's license, and many other cards and documents.

Similarly, increases in amount and intrusiveness of airport security at such checkpoints have also presented numerous issues and inconveniences for the travelers. When passing through a typical airport security checkpoint that includes both a walk-through metal detector and a conveyor belt driven X-ray machine for carry-on luggage, the travelers must typically remove all metal objects from their persons and are often required to remove their shoes for security inspection. Currently, these items are placed into plastic tubs or bins that are either passed through the X-ray machine or around the metal detector, while the travelers, often barefoot, pass through the metal detector.

Due to a high volume of people in an area around the checkpoint, passing through the metal detector without shoes may be unhygienic or embarrassing for the travelers. Also, when the travelers pass through the metal detector without shoes, the travelers often face an increased risk of slipping and falling. Similarly, when the travelers pass through the metal detector without shoes, the travelers may result in emittance of unpleasant foot odors. Moreover, passing through the metal detector without shoes may be disgusting or not aesthetically pleasing to the travelers themselves or others nearby if the shoes are dirty.

Additionally, after the travelers have passed through the security checkpoint, the travelers typically put the removed shoes back on, which often cause traveler traffic flow problems at the security checkpoint area as many travelers similarly attempt to put their shoes back on at about the same time. This can also reduce operational efficiency of the checkpoint if there are a lot of people around the checkpoint.

What is needed are better, more orderly ways of dealing with these issues or inconveniences.

While certain aspects of conventional technologies have been discussed to facilitate the present disclosure, no technical aspects are disclaimed. The claims may encompass one or more of the conventional technical aspects discussed herein.

BRIEF SUMMARY

The present disclosure addresses at least one of the above. However, the present disclosure may prove useful in addressing other problems and deficiencies in a number of technical areas. Therefore, the claims, as recited below, should not necessarily be construed as limited to addressing any of the particular problems or deficiencies discussed herein.

An example embodiment of the present disclosure is a kit for use by an airline traveler having an item of carry-on luggage in an airport having a security checkpoint where the traveler is required to remove the traveler's shoes for security inspection. The kit includes a pair of socks configured for wearing on the traveler's feet in order to keep unhygienic substances in proximity of the checkpoint away from the feet when the traveler walks through the checkpoint without the shoes. The kit also includes a handheld travel pouch having an inner space and a pocket. The inner space is configured for storing the pair of socks. The pocket is configured for storing a card for providing proof of identity of the traveler. The pocket is configured for allowing of quick removal of the card for display at the checkpoint. The kit further includes a means for securing the pouch to the item, the means coupled to the pouch.

Another example embodiment of the present disclosure is a kit for use by an airline traveler having an item of carry-on luggage in an airport having a security checkpoint where the traveler is required to remove the traveler's shoes for security inspection. The kit includes a pair of washable, odor blocking and slip resistant socks configured for wearing on the traveler's feet in order to keep unhygienic substances in proximity of the checkpoint away from the feet when the traveler walks through the checkpoint without the shoes. Each of the socks has a fold line. The pair of socks is one size fits all. The pair of socks is configured for wearing over another pair of socks. The kit also includes a handheld travel pouch having an inner space and a pocket. The inner space is configured for storing the pair of socks. The pocket is configured for storing a card for providing proof of identity of the traveler. The pocket is configured for allowing of quick removal of the card for display at the checkpoint. Each of the socks is folded along the fold line in the inner space. The pouch is at least one of washable and dry cleanable. The kit further includes a disposable antibacterial sanitizing wipe configured for wiping the traveler's hands after handling the pair of socks. The pouch is configured for storing the wipe. The kit additionally includes a means for securing the pouch to the item, the means coupled to the pouch.

The present disclosure may be embodied in the form illustrated in the accompanying drawings. Attention is called to the fact, however, that the drawings are illustrative. Variations are contemplated as being part of the disclosure, limited only by the scope of the claims. The above and other features, aspects and advantages of the present disclosure will become better understood to one skilled in the art with reference to the following drawings, detailed description and appended claims.

BRIEF DESCRIPTION OF THE DRAWINGS

The accompanying drawings, which are incorporated into and form a part of the specification, illustrate example embodiments of the present disclosure. Together with the detailed description, the drawings serve to explain the principles of the present disclosure. The drawings are only for the purpose of illustrating example embodiments of the present disclosure and are not to be construed as necessarily limiting the disclosure. Like numbers can refer to like elements throughout. The above and other aspects, advantages and features of the present disclosure will become better understood to one skilled in the art with regard to the following description, appended claims and accompanying drawings where:

DETAILED DESCRIPTION OF THE PREFERRED EMBODIMENTS

Figure 1A:
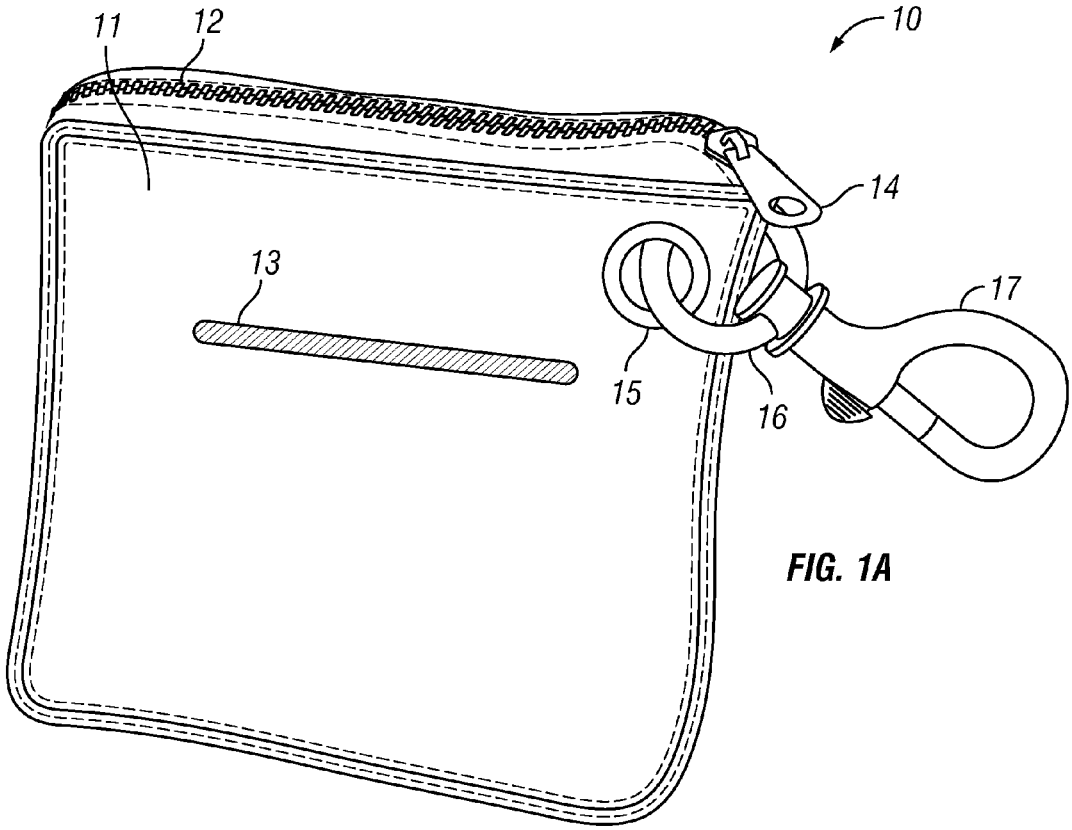
FIG. 1A is a perspective view of an example embodiment of a travel pouch according to the present disclosure.

The present disclosure will now be described more fully with reference to the accompanying drawings, in which example embodiments of the disclosure are shown. The disclosure may, however, be embodied in many different forms and should not be construed as being limited to the embodiments set forth herein. Rather, these embodiments are provided so that this disclosure will be thorough and complete, and will fully convey the concept of the disclosure to those skilled in the art.

According to the present disclosure, any verbs as used herein can imply direct or indirect, full or partial, action or inaction. For example, when an element is referred to as being "on," "connected" or "coupled" to another element, it can be directly connected or coupled to the other element or intervening elements may be present. In contrast, when an element is referred to as being "directly connected" or "directly coupled" to another element, there are no intervening elements present.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. It will be further understood that the terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Furthermore, relative terms such as "below," "lower," "above," and "upper" may be used herein to describe one element's relationship to another element as illustrated in the accompanying drawings. It will be understood that relative terms are intended to encompass different orientations of the device in addition to the orientation depicted in the accompanying drawings. For example, if the device in the accompanying drawings is turned over, elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The corresponding structures, materials, acts, and equivalents of all means or step plus function elements in the claims below are intended to include any structure, material, or act for performing the function in combination with other claimed elements as specifically claimed.

According to the principles of the present disclosure, any components or materials can be formed from a same, structurally continuous piece or separately fabricated and connected.

An aspect of an example embodiment of the present disclosure to more easily provide important traveling documentation, while presenting a more hygienic, a more traveler traffic flow friendly and a more aesthetically pleasing, yet less embarrassing, less prone to unpleasant foot odor and less slippery prone way of passing through a body scanner at a security checkpoint. Accordingly, a security checkpoint friendly lightweight travel pouch is provided. The pouch includes a storage portion providing secure access to a folded pair of slip resistant socks folded at a plurality of fold lines. The pouch also includes an ID storage portion for secure yet easily accessible storage of an ID document. The pouch further includes a means for secure attachment to an item of carry-on luggage.

An example embodiment of the present disclosure is a kit for use by an airline traveler having an item of carry-on luggage in an airport having a security checkpoint where the traveler is required to remove the traveler's shoes for security inspection. The kit includes a pair of socks configured for wearing on the traveler's feet in order to keep unhygienic substances in proximity of the checkpoint away from the feet when the traveler walks through the checkpoint without the shoes. The kit includes a handheld travel pouch having an inner space and a pocket. The inner space is configured for storing the pair of socks. The pocket is configured for storing a card for providing proof of identity of the traveler. The pocket is configured for allowing of quick removal of the card for display at the checkpoint. The kit includes a means for securing the pouch to the item. The means is coupled to the pouch. The pair of socks can be slip resistant and washable. The pair of socks can be configured for blocking emittance of an odor from the feet. Each of the socks can have a fold line. Each of the socks can be folded along the fold line in the inner space. The pair of socks can be one size fits all. The pair of socks can be configured for wearing over another pair of socks. The pair of socks can be sufficiently long to be at least ankle high on the traveler. The pair of socks can include a slip resistant marking. The pair of socks can include cotton. At least one of the socks can have a logo commercially associated with the pair of socks. The kit can include a disposable antibacterial sanitizing wipe configured for wiping the traveler's hands after handling the pair of socks. The pouch can be configured for storing the wipe. The pair of socks can be waterproof. The pouch can include a zipper configured for controlling access to the inner space. The pouch can be at least one of washable and dry cleanable. The pouch can include a logo external to the inner space. The logo can be commercially associated with the pouch. The pocket can be external to the inner space. The pocket can include a transparent cover configured for covering the card. The cover can be configured for allowing quick display of the card at the checkpoint. The pocket can be accessible via the inner space.

FIG. 1A is a perspective view of an example embodiment of a travel pouch according to the present disclosure. A security checkpoint friendly lightweight travel pouch 10 includes a storage portion 11, a zipper line 12, a side pocket 13, a slider 14, a storage portion ring 15, a latch ring 16 and a swivel snap latch 17.

Although storage portion 11 includes stitching all around near edges, storage portion 11 can be devoid of stitching all around and be manufactured out of a single piece of material. External portion of storage portion 11 can have dimensions of 5 inches by 4.5 inches and be manufactured out of fabric of any color. Internal portion of storage portion 11 can have dimensions of 4.5 by 4 inches and be manufactured of nylon lining with printed tone on tone logo. Storage portion 11 includes storage portion ring 15, which can include a metal, such as gold or brass, stationed on a corner of storage portion 11. Reverse side of storage portion 11 includes an ID storage portion with plastic cover disposed over the ID storage portion for storage of an ID document.

Zipper line 12 and slider 14 are used for temporarily joining two edges of storage portion 11 by interlocking teeth of slider 14 and increase the size of an opening of storage portion 11 to allow a passage of objects into storage portion 11. Zipper line 12 and slider 14 provide secure storage and can be of same color as stitching on storage portion 11. Slider 14 slides one way to open storage portion 11 and an opposing way to close storage portion 11. Zipper 12 can be coil, metallic, plastic-molded, invisible, open-ended and closed-ended. Slider 14 can be in one-way or 2-way styles and may come with an auto-lock latch or decorative fob.

Side pocket 13 is stationed on an external side of storage portion 11 and can store multiple hand sanitizer bottles or packets or sanitizing wipes within. Alternatively, side pocket 13 can be used to store other items, such as a credit card or a state issued driver's license. Opening of side pocket 13 can be 2 inches wide and 2 inches deep. Side pocket 13 is accessed via a slit opening on the side of storage portion 11.

A means for securing pouch 10 to an item of carry-on luggage can include a latch ring 16 secures around storage portion ring 15. Latch ring 16 can be manufactured out of metal, such as gold or brass. Latch ring 16 is coupled to swivel snap latch 17, which secures onto carry-on luggage.

Swivel snap latch 17 is used for detachable strapping hooked via latch ring 16 onto storage portion ring 15. Swivel snap latch 17 can include center bar, heel bar or roller bar styles.

In alternative example embodiments, the means can be for permanent or temporary securing. The means can include fasteners, glue or epoxy or threading. The means can be any technology for securing pouch 10 to the item whether via fastening, attaching, joining, connecting, securing, holding, or clamping components together. Fasteners can include screws, nuts and bolts, rivets, snap-fits, tacks, nails, buttons, hook/loop fasteners, interlocking male/female connectors and others as known in the art at the time of filing of the present disclosure. The means can include hook and loop fasteners, snap fasteners, button-buttonhole fasteners, interlocking fasteners, zippers, eyes and hooks, snaps, strings, adhesives, surface tensioners, magnetic strips and safety pins Pouch 10 internally stores a pair of slip resistant socks for use prior to and after passing a body scanner at a travel security checkpoint. The socks are hand-washable, match the color of pouch 10 and can be of any size, such as small, medium or large. The socks can also be foldable across one or more fold lines. Bottoms of the socks include a logo, such as travel foot logo.

Figure 1B:
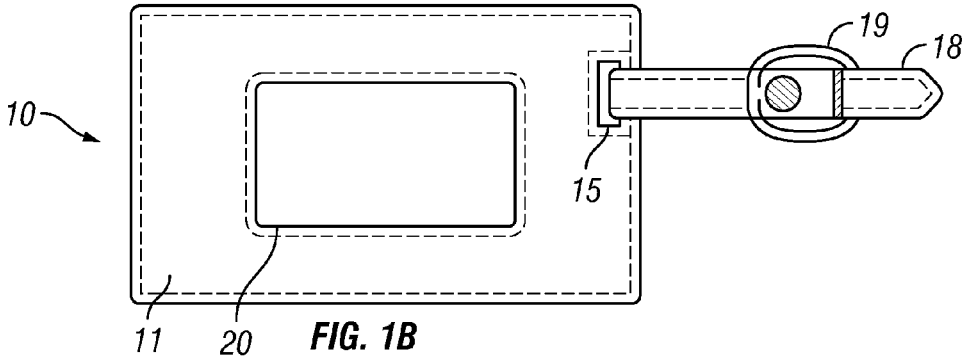
FIGS. 1B and 1C are side views of another example embodiment of a travel pouch according to the present disclosure.
Figure 1C:
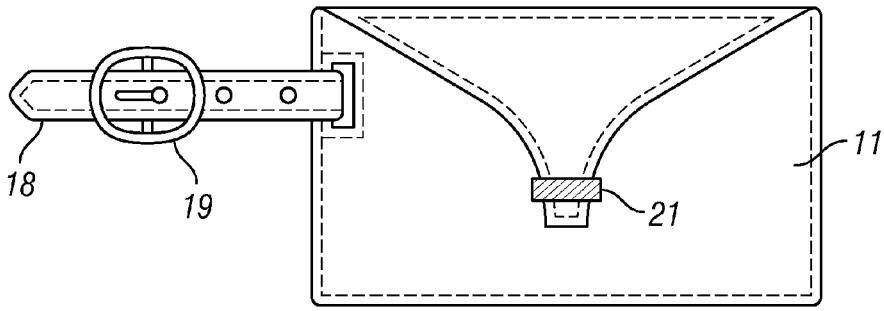

FIGS. 1B and 1C are side views of another example embodiment of a travel pouch according to the present disclosure. Some elements of FIGS. 1B and 1C are described above with respect to FIG. 1A. Thus, same reference characters identify same or like components described above and any repetitive detailed description thereof will hereinafter be omitted or simplified in order to avoid complication.

Pouch 10 includes storage portion 11, storage portion 11, storage portion ring 15, a belt 18, a buckle 19, an ID storage portion 20 and a metal strap 21.

Storage portion 11 includes stitching all around near edges. Storage portion includes a side which Storage portion 11 includes storage portion ring 15 stationed at corner of storage portion 11. One side of storage portion 11 includes ID storage portion 20 with plastic cover disposed over ID storage portion 20 for storage of an ID document. Alternatively, ID storage portion 20 is devoid of the plastic cover. Another side of storage portion 11 has an envelope shape and, for security, includes a portion tucked into metal strap 21. The envelope shape side attaches to storage portion 11 via a fabric hook-and-loop fastener, known commercially as VELCRO®.

Belt 18 is secured around storage portion ring 15. Belt 18 includes stitching on edges and can be manufactured out of leather. Belt 18 includes buckle 19, which is used for fastening two loose ends, with one end attached to buckle 19 and the other held by a catch in a secure, but adjustable manner. Buckle frame can be manufactured out of metal, such as gold, silver or brass. For a proper fit, an inner diameter of buckle 19 is measured to be equal a width of belt 18.

Similarly to pouch 10 shown in FIG. 1A, pouch 10 shown in FIG. 1B can store a pair of slip resistant socks for use prior to and after passing a body scanner at a travel security checkpoint.

Figure 2A:
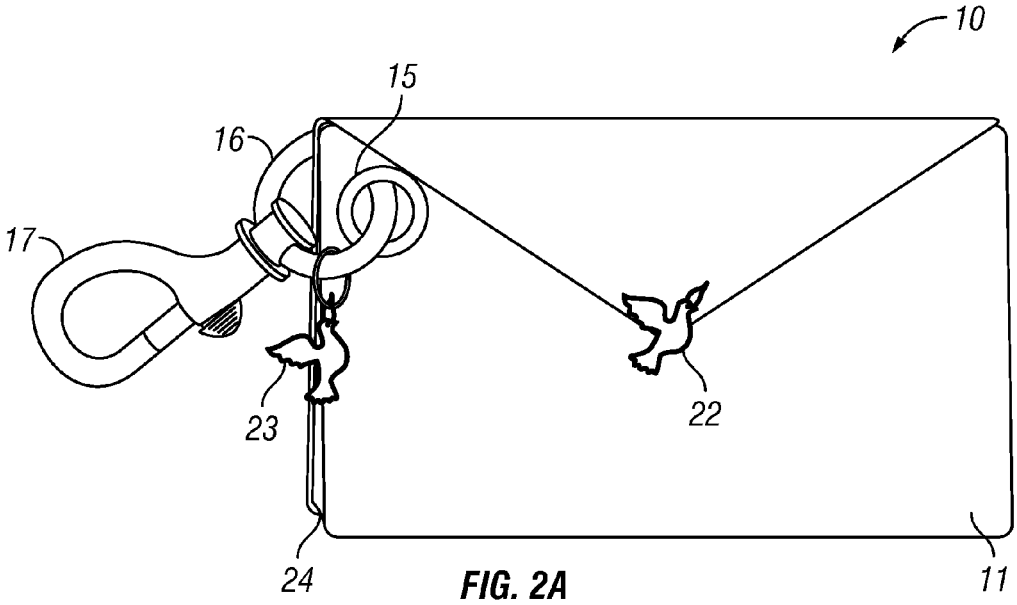
FIGS. 2A and 2B are perspective views of yet another example embodiment of a travel pouch according to the present disclosure.
Figure 2B:
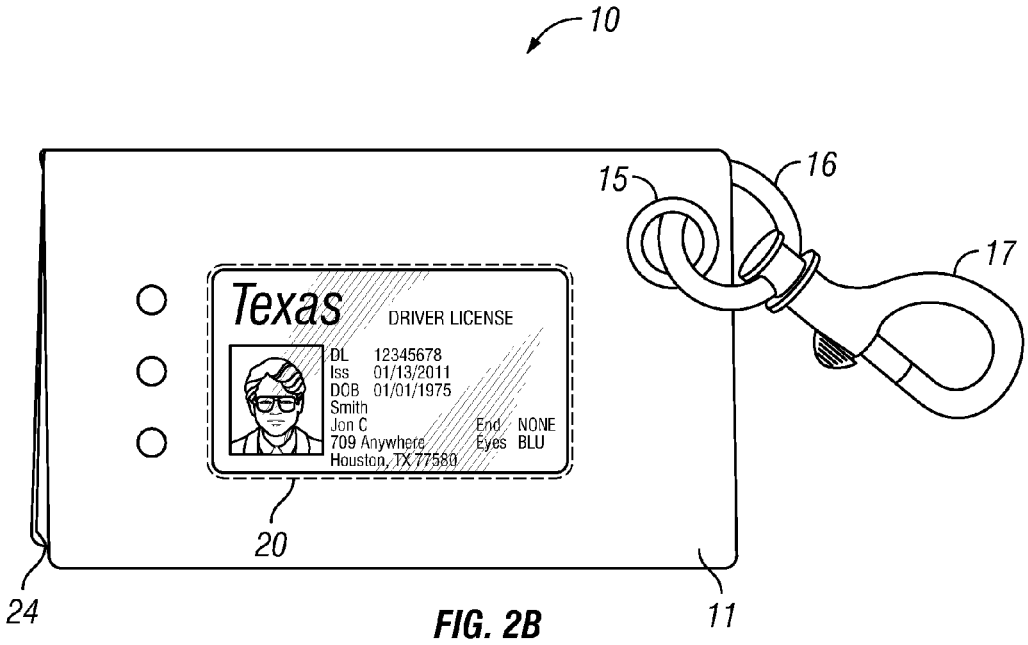

FIGS. 2A and 2B are perspective views of yet another example embodiment of a travel pouch according to the present disclosure. Some elements of FIGS. 2A-2B are described above with respect to FIGS. 1A-1C. Thus, same reference characters identify same or like components described above and any repetitive detailed description thereof will hereinafter be omitted or simplified in order to avoid complication.

Pouch 10 includes storage portion 11, storage portion ring 15, latch ring 16, swivel snap latch 17, ID storage portion 20, a magnetic snap fastener 22, a logo piece 23 and a storage portion base 24.

Storage portion 11 includes storage portion base 24, which allows pouch 10 to stand on its own.

Logo piece 23 is secured onto latch ring 16 via a logo piece ring.

For security, envelope shape side of storage portion 11 includes a portion securable onto storage portion 11 via magnetic snap fastener 22, which may be a snap, dome or press stud. Magnetic snap fastener 22 is a pair of interlocking discs used to fasten the envelop shape side of storage portion 11 to storage portion 11. A circular lip under one disc fits into a groove on top of another disc, holding the discs fast until a certain amount of force is applied. The larger of the two discs includes a logo, such as a travel foot logo.

ID storage portion 20 stores a state issued driver's license.

Similarly to pouch 10 shown in FIGS. 1A-1C, pouch 10 shown in FIGS. 2A-2B can store a pair of slip resistant socks for use prior to and after passing a body scanner at a travel security checkpoint.

Figure 3:
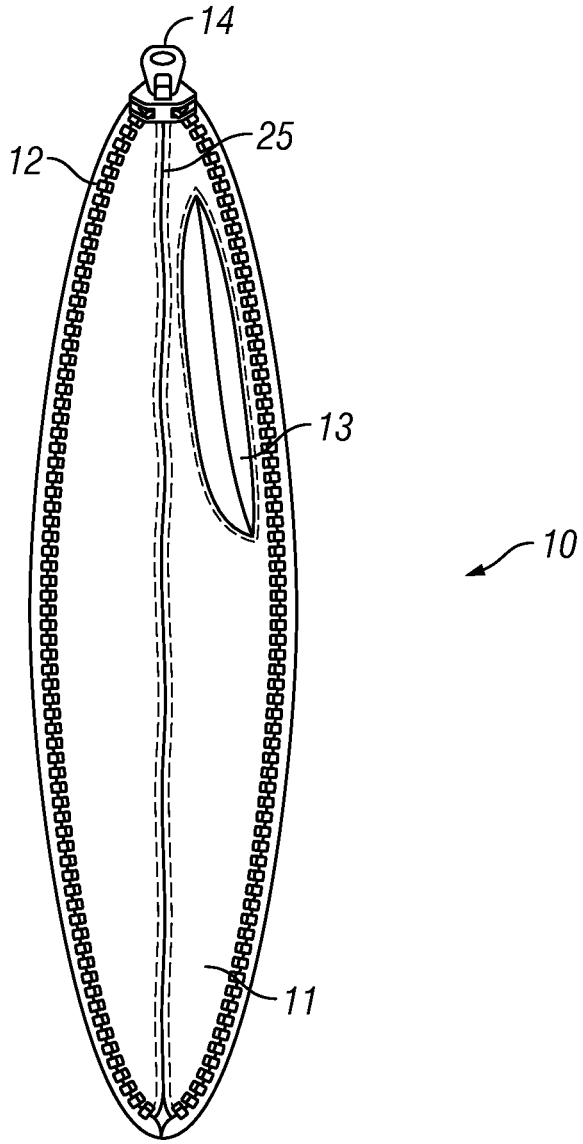
FIG. 3 is a top view of yet another example embodiment of a travel pouch according to the present disclosure.

FIG. 3 is a top view of yet another example embodiment of a travel pouch according to the present disclosure. Some elements of FIG. 3 are described above with respect to FIG. 1A-1C and 2A-2B. Thus, same reference characters identify same or like components described above and any repetitive detailed description thereof will hereinafter be omitted or simplified in order to avoid complication.

Pouch 10 includes storage portion 11, zipper 12, side pocket 13, slider 14 and an internal bottom seam 25. As shown, pouch 10 is in an open state, thus making internal bottom seam 25 of storage portion 11 visible. In contrast to FIG. 1A, zipper 12 is also in an open state with slider 14 positioned accordingly. Also in contrast to FIG. 1A, side pocket 13 is stationed on an internal side of storage portion 11, thus enhancing security by limiting access to side pocket 13.

Similarly to pouch 10 shown in FIGS. 1A-1C and 2A-2B, pouch 10 shown in FIG. 3 can store a pair of slip resistant socks for use prior to and after passing a body scanner at a travel security checkpoint.

Figure 4:
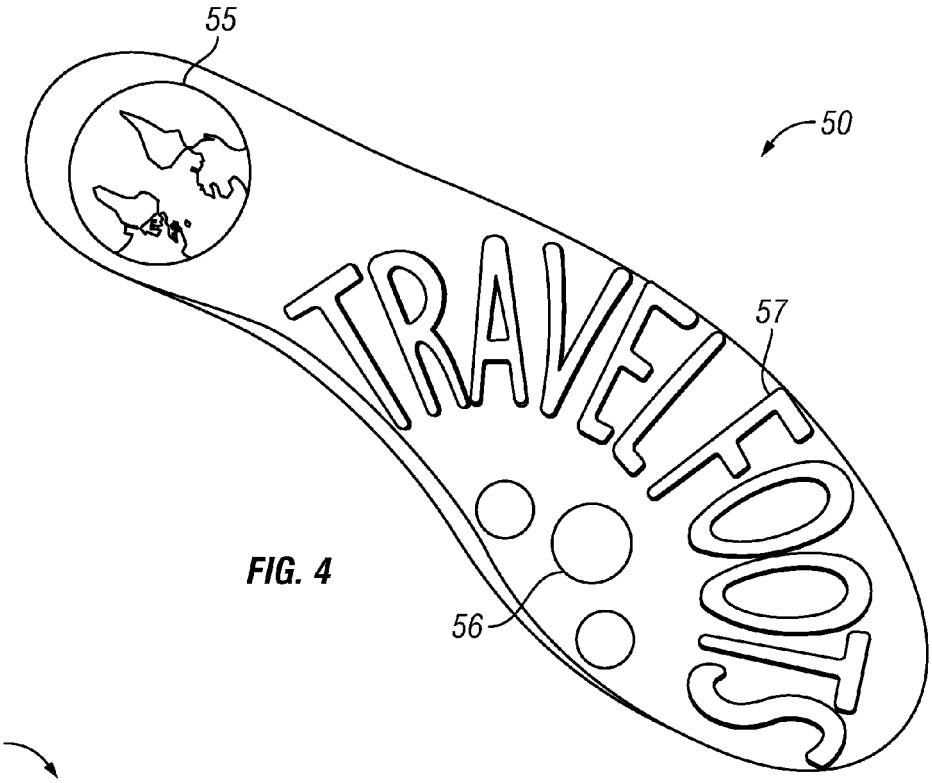
FIGS. 4 and 5 are bottom and top views of an example embodiment of a slip resistant sock storable within a travel pouch according to the present disclosure.
Figure 5:
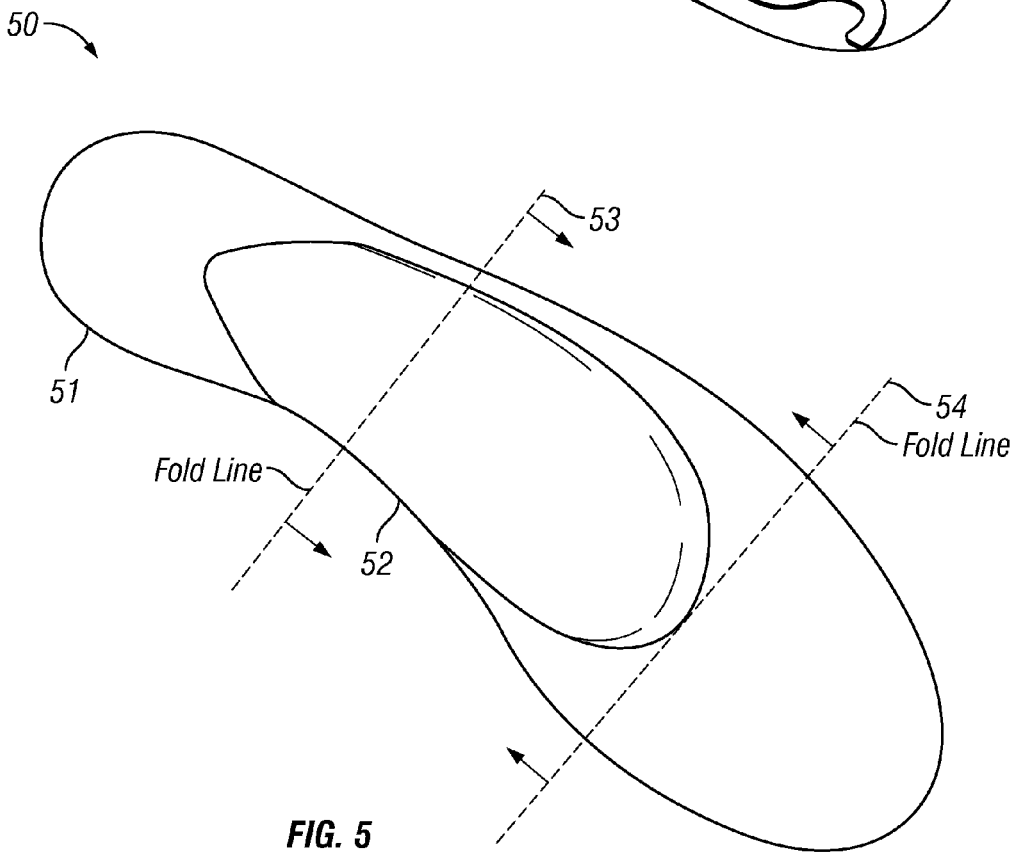

FIGS. 4 and 5 are bottom and top views of an example embodiment of a slip resistant sock storable within a travel pouch according to the present disclosure.

A sock 50 includes a material portion 51 and an opening portion 52. Sock 50 is foldable across fold lines 53 and 54.

A sole portion of sock 50 includes slip resistant markings 55, 56 and 57. Some of the markings may be in shape of items, such as a globe, or letters, such as travel foots, or in geometric shapes, such as circles. Sock 50 can include bacteria and/or germ resistant material for protect whoever wears sock 50 from bacteria and/or germ infestation. Socks 50 can be waterproof.

In one mode of operation, before leaving to an airport, a traveler attaches pouch 10 to an item of carry-on luggage. Pouch 10 stores an identification document, a pair of folded socks 50 folded at a plurality of fold lines and a hand sanitizer bottle stored within side pocket 13. Prior to passing through a body scanner, the traveler unzips pouch 10, removes a pair of socks 50 from pouch 10, removes shoes from the traveler's feet, puts on socks 50, walks through the body scanner, removes socks 50 from the feet, puts the removed shoes back on, inserts socks 50 into pouch 10, removes hand sanitizer bottle, dispenses hand sanitizer on the traveler's hands, inserts hand sanitizer back into pouch 10 and with sanitized hands zips up pouch 10. After arrival to the traveler's destination, the traveler hand washes socks 50 and reuses socks 50 on a return trip.

By having access to pouch 10 storing socks 50 and a hand sanitizer bottle, the traveler improves hygiene and reduces a cost associated with washing socks 50 and risk of slipping and falling, embarrassment and emittance of unpleasant foot odor, while presenting as aesthetically pleasant to others nearby. Similarly, the traveler minimizes traffic flow problems as the traveler can quickly walk away from the body scanner upon retrieving the carry-on luggage and the removed shoes and put on the shoes in a place with less people. Also, the traveler keeps important traveling documentation readily available if demanded by a security officer at the security checkpoint.

In another example embodiment, the kit is for easy wear and for easy care for traveling in a relatively clean manner because travel is a prime place for germs and other pathogens to flourish as one of the leading settings for bacterial infestation via feet is apparent as one is waiting to be checked-in/body-searched at an airport security center. The kit includes socks, which are created from washable, comfortable soft-breathable cotton products. The socks can be ankle high and/or one inch high socks, which serve multiple purposes. As one is waiting to go through airport security centers, the socks have a skid-resistance-traction section and are made for "easy on and easy off", thus eliminating the wearer's feet touching the dirty, wet, slimy and germ infested floors. If one is wearing socks already, then the one-size fits all socks can be used by just slipping them over existing socks. The socks can be used after the security center. Once seated on the plane, the passenger can place these socks on for the second time, enabling him/her from sitting and walking around the cabin in comfort and cleanliness for a more enjoyable flight, especially when visiting the public bathroom en-flight. And for the one-time or two-time "easy-on-easy-off" user's hands, the kit includes in a small compartment in the carrying case are several, such as ½, envelopes of anti-bacterial packets for easy wash for additional cleanliness. The kit includes a carry case which on the outside is four inches by six inches zippered sides with a four inch strap to be attached to the carry-on case and/or hand-bag. The case can be vinyl product which is washable. The case is adorned with company logo medallion will on front as well as logo initials incised on a zipper pull. The kit can include transparent/covered window for personal ID to be located outside/inside carry case. On the inside, the case is constructed from synthetic lambskin/polyurethane/polyester microfibers. The case color fast to Light: AATCC 16A (40 hours) Class 4. Flame Test: UFAC-Barrier Method. The case can be washable and dry Cleanable. To clean the case, one has to wash with mild-soap and water. For stubborn stains one can use a mild solvent. The case can resist, without serious discoloration, the repeated actions of normal dilution of nonabrasive cleaners.

In conclusion, herein are presented kits for use by airline travelers and methods of their operation. The description of the present disclosure has been presented for purposes of illustration and description, but is not intended to be exhaustive or limited to the disclosure in the form disclosed. The embodiments were chosen and described in order to best explain the principles of the disclosure and the practical application, and to enable others of ordinary skill in the art to understand the disclosure for various embodiments with various modifications as are suited to the particular use contemplated. Many modifications and variations in techniques and structures will be apparent to those of ordinary skill in the art without departing from the scope and spirit of the disclosure. Accordingly, such modifications and variations are contemplated as being a part of the present disclosure. The scope of the present disclosure is defined by the claims, which includes known equivalents and unforeseeable equivalents at the time of filing of this application.

What is claimed is:

1. A kit for use by an airline traveler having an item of carry-on luggage in an airport having a security checkpoint where the traveler is required to remove the traveler's shoes for security inspection, the kit comprising:

a pair of socks configured for wearing on the traveler's feet in order to keep unhygienic substances in proximity of the checkpoint away from the feet when the traveler walks through the checkpoint without the shoes;

a handheld travel pouch having an inner space and a pocket outside the inner space, the inner space storing the pair of socks only, the pocket storing an identity card, the pocket allowing quick removal of the card for display at the checkpoint, the pouch having a ring; and a means for securing the pouch to the item, the means coupled to the pouch via the ring.

2. The kit as recited in claim 1, wherein the pair of socks is slip resistant and washable.

3. The kit as recited in claim 2, wherein the pair of socks is configured for blocking emittance of an odor from the feet.

4. The kit as recited in claim 3, wherein each of the socks has a fold line, each of the socks folded along the fold line in the inner space.

5. The kit as recited in claim 4, wherein the pair of socks is one size fits all, the pair of socks configured for wearing over another pair of socks.

6. The kit as recited in claim 1, wherein the pair of socks is sufficiently long to be at least ankle high on the traveler.

7. The kit as recited in claim 1, wherein the pair of socks includes a slip resistant marking.

8. The kit as recited in claim 1, wherein the pair of socks includes cotton.

9. The kit as recited in claim 1, wherein at least one of the socks has a logo commercially associated with the pair of socks.

10. The kit as recited in claim 1, further comprising a disposable antibacterial sanitizing wipe configured for wiping the traveler's hands after handling the pair of socks, the pouch configured for storing the wipe in the pocket.

11. The kit as recited in claim 1, wherein the pair of socks is waterproof.

12. The kit as recited in claim 1, wherein the pouch is includes a zipper configured for controlling access to the inner space.

13. The kit as recited in claim 1, wherein the pouch is at least one of washable and dry cleanable.

14. The kit as recited in claim 1, wherein the pouch includes a logo external to the inner space, the logo commercially associated with the pouch.

15. The kit as recited in claim 1, wherein the pocket is external to the inner space, the pocket including a transparent cover configured for covering the card, the cover configured for allowing quick display of the card at the checkpoint.

16. The kit as recited in claim 1, wherein the pocket is accessible via the inner space.

17. A kit for use by an airline traveler having an item of carry-on luggage in an airport having a security checkpoint where the traveler is required to remove the traveler's shoes for security inspection, the kit comprising:

a pair of washable, odor blocking and slip resistant socks configured for wearing on the traveler's feet in order to keep unhygienic substances in proximity of the checkpoint away from the feet when the traveler walks through the checkpoint without the shoes, each of the socks has a fold line, the pair of socks is one size fits all, the pair of socks configured for wearing over another pair of socks;

a handheld travel pouch having an inner space and a pocket outside the inner space, the inner space storing the pair of socks only, the pocket storing an identity card, the pocket allowing quick removal of the card for display at the checkpoint, each of the socks folded along the fold line in the inner space, the pouch is at least one of washable and dry cleanable, the pouch having a ring; and a disposable antibacterial sanitizing wipe configured for wiping the traveler's hands after handling the pair of socks, the pouch storing the wipe in the pocket;

a means for securing the pouch to the item, the means coupled to the pouch via the ring.

18. The kit as recited in claim 17, wherein the pocket is external to the inner space, the pocket including a transparent cover configured for covering the card, the cover configured for allowing quick display of the card at the checkpoint without removing the card.

19. A kit for use by an airline traveler having an item of carry-on luggage in an airport having a security checkpoint where the traveler is required to remove the traveler's shoes for security inspection, the kit comprising:

a pair of socks configured for wearing on the traveler's feet in order to keep unhygienic substances in proximity of the checkpoint away from the feet when the traveler walks through the checkpoint without the shoes;

a handheld travel pouch having an inner space and a pocket outside the inner space, the inner space storing the pair of socks only, the pocket storing an identity card, the pocket allowing quick removal of the card for display at the checkpoint, the pouch having a ring; and a latch for securing the pouch to the item, the latch coupled to the pouch via the ring.

20. The kit of claim 19, wherein the pair of socks is slip resistant, each of the socks has a fold line, each of the socks folded along the fold line in the inner space.

* * * * *